US009957584B2

(12) United States Patent
Campbell et al.

(10) Patent No.: US 9,957,584 B2
(45) Date of Patent: May 1, 2018

(54) METHOD AND SYSTEM FOR ENHANCING RIVETABILITY

(71) Applicant: Ford Motor Company, Dearborn, MI (US)

(72) Inventors: Aindrea McKelvey Campbell, Beverly Hills, MI (US); Constantin Chiriac, Windsor (CA); Garret Sankey Huff, Ann Arbor, MI (US); Raj Sohmshetty, Canton, MI (US)

(73) Assignee: Ford Motor Company, Dearborn, MI (US)

( * ) Notice: Subject to any disclaimer, the term of this patent is extended or adjusted under 35 U.S.C. 154(b) by 243 days.

(21) Appl. No.: 14/822,323

(22) Filed: Aug. 10, 2015

(65) Prior Publication Data

US 2017/0044637 A1 Feb. 16, 2017

(51) Int. Cl.

| | |
|---|---|
| ***B21J 15/00*** | (2006.01) |
| ***B21J 15/02*** | (2006.01) |
| ***B21J 15/08*** | (2006.01) |
| ***B21J 15/28*** | (2006.01) |
| ***B21J 15/14*** | (2006.01) |
| ***C21D 1/40*** | (2006.01) |
| ***C21D 9/00*** | (2006.01) |
| ***C21D 9/46*** | (2006.01) |
| ***C22C 21/00*** | (2006.01) |

(52) U.S. Cl.

CPC ..... *C21D 9/46* (2013.01); *B21J 15/00* (2013.01); *B21J 15/025* (2013.01); *B21J 15/08* (2013.01); *B21J 15/147* (2013.01); *B21J 15/28* (2013.01); *C21D 1/40* (2013.01); *C21D 9/0006* (2013.01); *C22C 21/00* (2013.01)

(58) Field of Classification Search

CPC . B21J 15/025; B21J 15/00; B21J 15/08; B21J 15/147; B21J 15/28; C21D 9/46; C21D 1/40; C21D 9/0006; C22C 21/00

See application file for complete search history.

(56) References Cited

U.S. PATENT DOCUMENTS

| | | | | |
|---|---|---|---|---|
| 6,417,490 | B1 | 7/2002 | Liebrecht et al. | |
| 6,694,597 | B2 * | 2/2004 | Wang | B21J 15/025 29/525.05 |
| 6,921,444 | B2 | 7/2005 | Joaquin et al. | |
| 2005/0161965 | A1 * | 7/2005 | Eberlein | B21J 15/025 296/29 |
| 2009/0188589 | A1 * | 7/2009 | Okitsu | C21D 6/005 148/504 |
| 2014/0290064 | A1 | 10/2014 | Smeyers et al. | |

FOREIGN PATENT DOCUMENTS

| | | | |
|---|---|---|---|
| EP | 2514538 | A1 | 10/2012 |

OTHER PUBLICATIONS

Easton, M. et al., "The Application of Magnesium Alloys to the Lightweighting of Automotive Structures", 2012, pp. 17-21.

* cited by examiner

*Primary Examiner* — Patrick D Niland

(74) *Attorney, Agent, or Firm* — Marla Johnston; Brooks Kushman P.C.

(57) ABSTRACT

A joined sheet stack and a method and system for forming the stack are disclosed. The stack may include a steel sheet and a second sheet. The steel sheet may include a bulk portion having a first tensile strength and one or more fastener regions having a second tensile strength that is lower than the first tensile strength and a microstructure that includes tempered martensite. A fastener may extend through each fastener region joining the steel sheet to the second sheet. The method may include heat treating one or more regions of a steel sheet to form one or more fastener regions having a tensile strength that is lower than a bulk tensile strength of the steel sheet and a microstructure that includes tempered martensite. A fastener may then be inserted into the one or more fastener regions to join the steel sheet to a second sheet.

19 Claims, 4 Drawing Sheets

METHOD AND SYSTEM FOR ENHANCING RIVETABILITY

TECHNICAL FIELD

The present disclosure relates to methods and systems for enhancing rivetability of, for example, structural sheet materials.

BACKGROUND

Highly engineered sheet materials may be used in modern vehicle body structures (e.g., automobiles). For safety, durability, and weight reduction considerations, structural parts may be made of high strength or ultra-high strength steel grades. Additionally, some parts may be made of alternate materials, such as aluminum. Joining two or more sheets with such diverse material properties may pose challenges. Resistance spot welding is a common method for joining multiple steel sheets. But, resistance spot welding may not be usable in mixed-material applications, such as steel and aluminum automotive body structures. If resistance spot welding is not an option, other material joining method may be used, such as adhesive bonding or mechanical fastening. However, there may also be engineering challenges in achieving effective joints using these alternate methods.

SUMMARY

In at least one embodiment, a sheet metal stack is provided. The stack may include a steel sheet including a bulk portion having a first tensile strength and one or more fastener regions having a second tensile strength that is lower than the first tensile strength and a microstructure that includes tempered martensite. The stack may also include a second sheet and a fastener extending through each fastener region joining the steel sheet to the second sheet.

The bulk portion may have a microstructure that includes 100% martensite and the first tensile strength may be at least 1200 MPa. In one embodiment, the second sheet is an aluminum sheet that is formed of a 5XXX, 6XXX, or 7XXX series aluminum alloy. The second tensile strength of the fastener regions may be less than 750 MPa. The stack may include one or more additional sheets. In one embodiment, the fastener regions may have a width of 1 to 25 mm. The fastener may be a self-piercing rivet. In one embodiment, the second sheet may have a substantially uniform tensile strength throughout.

In at least one embodiment, a method of joining a stack of sheets is provided. The method may include heat treating one or more regions of a steel sheet to form one or more fastener regions. The fastener regions may have a tensile strength that is lower than a bulk tensile strength of the steel sheet and a microstructure that includes tempered martensite. The method may include inserting a fastener into the one or more fastener regions to join the steel sheet to a second sheet.

In one embodiment, the bulk tensile strength of the steel sheet is at least 1200 MPa. The heat treating step may include forming one or more fastener regions having a tensile strength below 750 MPa. In one embodiment, the heat treating step may include heating the one or more regions of the steel sheet to a temperature that is less than an Ac3 temperature of the steel sheet and greater than 20° C. below an Ac1 temperature of the steel sheet. In another embodiment, the heat treating step may include heating the one or more regions of the steel sheet to a temperature that is within 25° C. of an Ac1 temperature of the steel sheet.

In one embodiment, the heat treating step may include heating the one or more regions of the steel sheet using resistive heating. The fastener may be a self-piercing rivet. The one or more fastener regions may have a width of 1 to 25 mm. The method may include reducing the temperature of the one or more regions to an ambient temperature before the inserting step. The second sheet may be formed from a 5XXX, 6XXX, or 7XXX series aluminum alloy.

In at least one embodiment, a system is provided including a heating apparatus configured to heat metal and a controller. The controller may be configured to control the heating apparatus to heat treat a portion of a metal sheet to a heat treatment temperature based on a plurality of pre-heat treatment properties of the steel sheet and a plurality of desired post-heat treatment properties of the steel sheet.

In one embodiment, the heating apparatus may be a resistive heating apparatus including a pair of electrodes configured to transfer current through the portion of the metal sheet to heat the portion to a heat treatment temperature that is less than an Ac3 temperature of the steel sheet and greater than 25° C. below an Ac1 temperature of the steel sheet.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
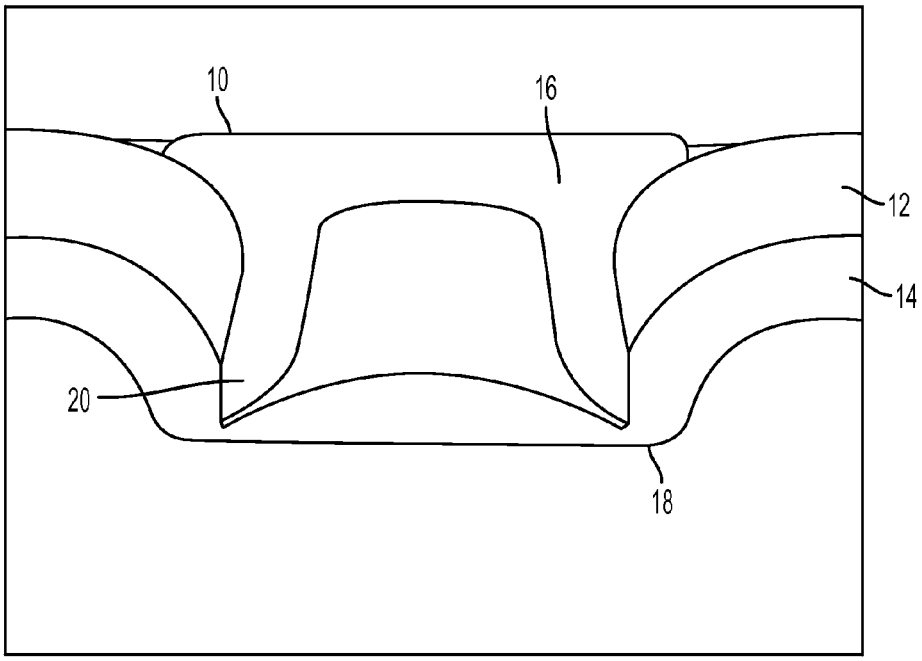
FIG. 1 is a cross-section of a self-piercing rivet joining two metal sheets.

As described in the Background, joining sheets of different metals may not be possible using conventional resistance spot welding. As a result, other joining methods may be needed, but these methods may also have challenges for mixed-material joining. An example of other approaches to joining sheets of different materials may include using mechanical fasteners. One mechanical fastening option is to use rivets, such as self-piercing rivets (SPRs). Traditional rivets have a head and a cylindrical body, the body is inserted into a hole in the components to be joined and then deformed to form a second head. Self-piercing rivets are another form of rivets in which no pre-made holes in the components to be joined are necessary. An example of an SPR 10 is shown in FIG. 1 joining a first, top component or sheet 12 and a second, bottom component or sheet 14. SPRs 10 generally include a hardened, semi-tubular body 16 that is inserted into the top component 12 (or components, if there are more than two in the stack) to be joined, but does not penetrate all the way through the bottom component 14. A bottom die may be placed below the bottom component 14, which causes the SPR 10 to flare and form an annular button 18 on the bottom component 14. The flared body 16 may be referred to as legs 20, for example, as shown in the cross-section of FIG. 1.

SPRs may be used to fasten two or more sheets or components, however, mixed-material stacks of components may pose engineering challenges. For example, if one of the sheets has even moderate strength (e.g., a tensile strength of at least 1100 MPa or more) and/or shows poor ductility, then the joint may experience defects. For example, cracking or micro-cracking of the rivet button may occur, the sheets within the stack may crack, the SPR and the sheets may separate, or the legs of the SPR may buckle. The joint defects may be caused or exacerbated by differences in material properties or composition between the components, such as differences in yield/tensile strength.

A number of alternative solutions have been investigated to address the problems with SPRs described above. Examples of these proposed solutions include utilizing a bolted connection, changing the sheet metal material, and developing more robust rivets. However, each of these approaches has potential drawbacks. For example, using a bolted connection may require a larger package space and may be more costly. Changes in the sheet metal material may require a redesign and may result in sub-optimal design or higher cost. More robust rivets that can work with difficult multi-material stack ups may not be available, and their research may be costly (as well as the final product).

Accordingly, the alternate solutions to SPRs may not be viable or cost effective, and methods and systems for improving or enhancing the rivetability of sheet materials so that current SPRs may be used would be highly beneficial. However, the methods should not reduce or compromise the strength of the component or sheets as a whole, thereby negating the benefit of using high-strength materials. The disclosed methods and systems may enhance the rivetability of sheet materials by locally modifying the material properties of the sheet(s) in the locations where rivets (e.g., SPRs) are to be placed. Accordingly, the bulk of the sheet(s) may maintain their high strength, but the sheet(s) may be joined to other materials (e.g., aluminum) using SPRs without defects being created in the SPR itself or the joint.

Figure 2:
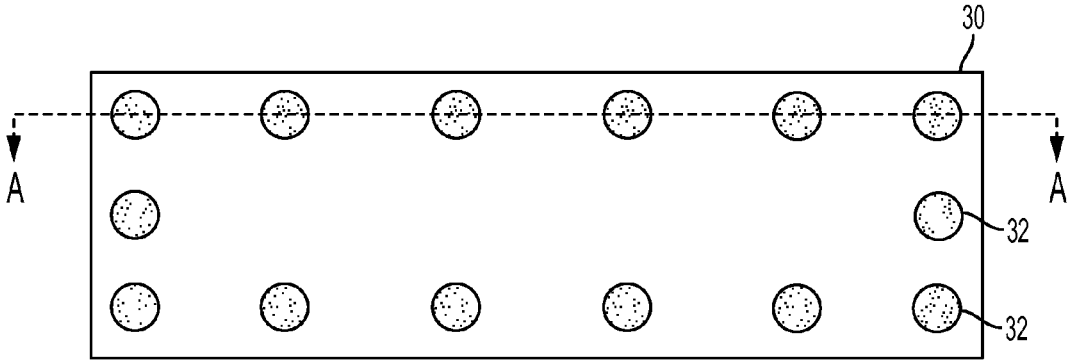
FIG. 2 is a top plan view of a metal sheet including a plurality of fastener regions, according to an embodiment.

With reference to FIG. 2, a top plan view of a metal sheet 30 is shown. The metal sheet 30 may include one or more fastener regions or portions 32 that will be mechanically fastened, for example by a SPR. While 14 regions 32 are shown, FIG. 2 is merely an example and the sheet 30 may include any suitable number of fastener regions 32. The regions 32 may be spaced apart, may be around a portion or all of the perimeter of the sheet 30, may be in a middle or bulk region of the sheet 30, or any combination thereof. In one embodiment, there may be a plurality of regions 32 (e.g., at least two). The number, location, size, and/or pattern of the regions 32 may depend on the type of component the sheet 30 will be incorporated into, the type of material the sheet 30 is made of, the dimensions of the sheet 30, the processing history of the sheet 3, or other factors, as well as the same factors of the sheet or sheets that sheet 30 will be joined to.

In at least one embodiment, the metal sheet 30 may be formed of a high strength material, such as a high strength steel. For example, the metal sheet 30 may be formed of a material with a tensile strength of at least 1200 MPa, such as at least 1300 MPa, 1400 MPa, 1500 MPa, 1600 MPa, 1700 MPa, 1800 MPa, or 1900 MPa. The metal sheet 30 material may have a yield strength of at least 800 MPa, such as at least 900 MPa, 1000 MPa, or 1100 MPa. In one embodiment, the metal sheet 30 may be formed of an ultra-high strength steel (UHSS). Accordingly, the metal sheet 30 may initially (e.g., before the disclosed method is performed) be formed of a martensitic steel. The steel may be completely martensitic (e.g., 100%) or substantially completely martensitic (e.g., ≥98%), or it may be at least partially martensitic, such as at least 50%, 60%, 70%, 80%, or at least 90%. In one embodiment, the metal sheet 30 may be formed of cold-rolled steel or press-hardened steel (PHS). The metal sheet 30 may also have high strength as a result of processing steps, such as heat treatments, cold working, or others.

The metal sheet 30 may have any composition capable of producing the disclosed strengths and/or microstructures. In one embodiment, the metal sheet 30 may be formed of a boron steel (e.g., having up to 0.01 wt % boron). In one embodiment, the metal sheet 30 may include up to 0.3 wt. % C, 0.5 wt. % Si, 0.03 wt. % P, 0.02 wt. % S, 1.5 wt. % Mn, 0.1 wt. % Al, 0.3 wt. % Cr, 0.1 wt. % Ti, and/or 0.01 wt. % B. The composition may include at least non-trace amounts of C, Mn, Al, Cr, Ti, and B (e.g., at least 0.0005 wt. %). One example of a suitable composition for metal sheet 30 may be Usibor® 22MnB5, which may have maximum concentrations of 0.25 wt. % C, 0.4 wt. % Si, 0.025 wt. % P, 0.015 wt. % S, 1.4 wt. % Mn, 0.06 wt. % Al, 0.25 wt. % Cr, 0.05 wt. % Ti, and/or 0.005 wt. % B and minimum concentrations of 0.19 wt. % C, 1.1 wt. % Mn, 0.02 wt. % Al, 0.15 wt. % Cr, 0.02 wt. % Ti, and/or 0.0008 wt. % B.

In order to improve or enhance the fastening ability, such as rivetability, of the metal sheet 30, the fastening regions 32 may be treated to improve their ductility and/or reduce their strength. In one embodiment, the fastening regions 32 may be heat treated. The heat treatment may be localized to only the fastening regions 32, which may be sized to match the size of the fastener or the fastener and the immediately surrounding area (e.g., an extra 1-2 mm in diameter). Fasteners, such as SPRs may have a range of diameters, depending on the application. For example, the fasteners may have a bore diameter of 1 to 25 mm, or any sub-range therein, such as 2 to 20 mm, 2 to 15 mm, 3 to 10 mm, or 3 to 5 mm. Accordingly, the fastening regions 32 may have the same size ranges (e.g., diameter or width), or may be larger by several mm (e.g., 1-2 mm) to allow for tolerances or flexibility.

In at least one embodiment, the fastening regions 32 may be heat treated to improve/increase the ductility of the metal sheet 30 in the fastening regions. The fastening regions 32 may be heat treated without significant heating to the rest of the metal sheet 30 (e.g., not heated sufficiently to change the microstructure and/or properties outside the regions 32). The heat treatment may be performed using any suitable method for heating metal. For example, the heat treatment may be performed using resistance heating, induction heating, infrared heating flame heating, laser heating, heating in a furnace (e.g., mask or insulate remainder of the sheet 30), or any other suitable method.

In one embodiment, resistance heating may be used to heat the fastening regions, and the heating may be provided using a resistance spot welding machine, or a modified version thereof. Resistance spot welding equipment and the process are known in the art and will not be described in detail. Generally, resistance spot welding includes sending high currents through electrode tips and the sheets/pieces of metal to be joined. Resistance at the faying surfaces of the pieces causes localized heating in the area to be joined, locally melting the pieces to form a weld. The electrodes may apply pressure to the pieces to facilitate the formation of the weld. In general, the weld process may be described by a cycle including a pressure time, weld time, hold time, and off time. The pressure time may be a period of time where the electrodes apply pressure but no current is flowing. The weld time may be a period of time or number of cycles (e.g., of AC current) during which current is flowing through the pieces. The hold time may be a period of time where the electrodes remain in contact with the pieces after current has been ceased. The off time may be a period of time during which the electrodes are separated to allow the electrodes or pieces to be moved (e.g., for another weld).

Figure 3:
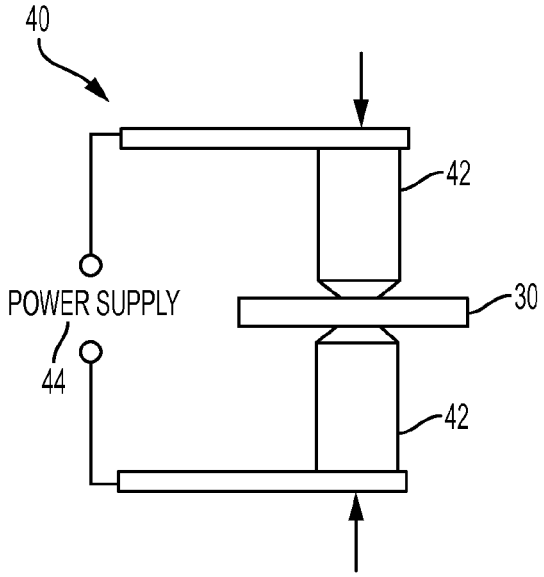
FIG. 3 is a schematic of a resistive heating apparatus that may be used to heat treat fastener regions of a metal sheet, according to an embodiment.

In embodiments where resistance heating is used to heat treat the metal sheet 30 in the fastener regions 32, a resistance spot welding machine, or a modification thereof, may be used. An example of a resistance heating system 40 is shown in FIG. 3. In at least one embodiment, only a single sheet 30 may be heated at a time, rather than two pieces being heated in order to form a weld. However, the general process may be the same or similar. Electrodes 42, generally (but not necessarily) made of copper, may be brought into contact with the metal sheet 30 at a fastener region 32, where a fastener will be used to join the sheet 30 to another sheet. Pressure may be applied by the electrodes, however, the pressure may be less than that which is applied during a spot welding procedure. In one embodiment, the pressure used may be low enough that no permanent deformation occurs in the sheet 30 (e.g., below the yield strength of the sheet). Current may then be sent through the electrodes and the sheet 30 by a power supply 44 (e.g., AC power supply) to cause resistive heating of the fastener region 32 during the "weld" time. Then there may be a hold time where current is not flowing through the electrodes but the electrodes are still in contact with the sheet 30 at the fastener region 32. Depending on factors such as the sheet 30 material, size, microstructure, or other properties, one or more cycles of the above may be performed on each fastener region (e.g., multiple weld and hold times).

In embodiments where the metal sheet 30 includes at least some martensite (either a portion or about 100%), the heat treatment may be configured to convert some or all of the martensite in the fastener region 32 to tempered martensite. If the fastener region 32 initially includes some tempered martensite, then the heat treatment may cause the fastener region 32 to have a higher tempered martensite content. The heat treatment may include heating the fastener region 32 to a temperature below the upper critical temperature, known as the Ac3 temperature. The Ac3 temperature is the temperature at which transformation of ferrite into austenite is completed upon heating (at equilibrium). In at least one embodiment, the heat treatment may include heating the fastener region 32 to a temperature that is below the Ac3 temperature but at or above a temperature near the lower critical temperature, known as the Ac1 temperature. The Ac1 temperature is the temperature at which austenite begins to form upon heating (at equilibrium). For example, the heat treatment may include heating the fastener region 32 to a temperature that is less than the Ac3 temperature and greater than 25° C. below the Ac1 temperature. Alternatively, the lower bound in the above range may be 20° C., 15° C., 10° C., or 5° C. below the Ac1 temperature. Or, the lower bound may be the Ac1 temperature or about the Ac1 temperature (e.g., within 3° C.). In another embodiment, the heat treatment may include heating the fastener region 32 to a temperature within a certain range of the Ac1 temperature, such as ±25° C., 20° C., 15° C., 10° C., or 5° C. In another embodiment, the heat treatment may include heating the fastener region 32 to a temperature within a certain range below the Ac1 temperature, such as from 25° C., 20° C., 15° C., 10° C., or 5° C. below the Ac1 temperature to the Ac1 temperature (or under the Ac1 temperature). The heat treatment may also include heating the fastener region 32 to a temperature of the Ac1 temperature or about the Ac1 temperature (e.g., ±5° C.).

The Ac1 and Ac3 temperatures vary depending on the composition of the metal sheet 30. In general steel Ac1 temperatures may be from about 675° C. to 775° C., for example 700° C. to 750° C. or 715° C. to 750° C. Steel Ac3 temperatures may be from about 750° C. to 900° C., for example, 750° C. to 850° C. or 775° C. to 825° C. However, certain compositions may have Ac1 and Ac3 temperatures outside of these ranges, which are not intended to be limiting. Therefore, in the heat treatment temperature ranges described above, the temperature will vary depending on the specific composition being treated. For example, if a certain composition has a Ac1 temperature of 721° C. and an Ac3 temperature of 850° C., then the heat treatment may heat the fastener region(s) 32 to a temperature of about 721° C. (about the Ac1 temperature), a temperature of over 701° C. to less than 850° C. (a temperature from 20 degrees below Ac1 to under Ac3), or any of the other disclosed temperatures or temperature ranges.

The resistance heating operating parameters, such as current, weld time, and number of cycles may be determined based on the incoming properties of the sheet 30 (e.g., composition, microstructure, geometry, etc.) and the desired properties of the fastener region 32 after the heat treatment (e.g., strength, microstructure, ductility, etc.). Accordingly, the resistance heating parameters may be tailored to each sheet 30 depending on the application. In general, increasing the current or the weld time will increase the temperature of the heat treatment. The number of cycles may be altered to adjust the total heat treatment time. The length of time required to transform at least some of the martensite in the fastener region 32 to tempered martensite may vary according to the composition of the metal sheet 30, the geometry of the sheet, the temperature of the heat treatment, or other factors. In general, the resistive heating time may be less than 1 minute, such as less than 30 seconds, 15 seconds, 10 seconds, 5 seconds, or 1 second. Parameters of the resistance heating process (e.g., current, weld time, # of cycles) for a certain fastener region 32 to form tempered martensite may be determined based on empirical data (e.g., from prior testing or from existing literature) or based on calculations or model simulations.

As described above, methods of heating the fastener regions 32 other than resistive heating may also be used. Heating methods such as induction heating, infrared heating, laser heating, flame heating, or others are known in the art and will not be described in detail. Similar to resistive heating, the time needed to transform at least a portion of the martensite to tempered martensite may be determined based on empirical data (e.g., from prior testing or from existing literature) or based on calculations or model simulations.

The time of the heat treatment for some heating methods may be longer than resistive heating, due to the lack of direct contact and slower heating rates. The time and parameters of the system used to heat the fastener regions may be adjusted in order to heat treat the fastener regions 32 at the disclosed temperature ranges to form tempered martensite.

Figure 4:
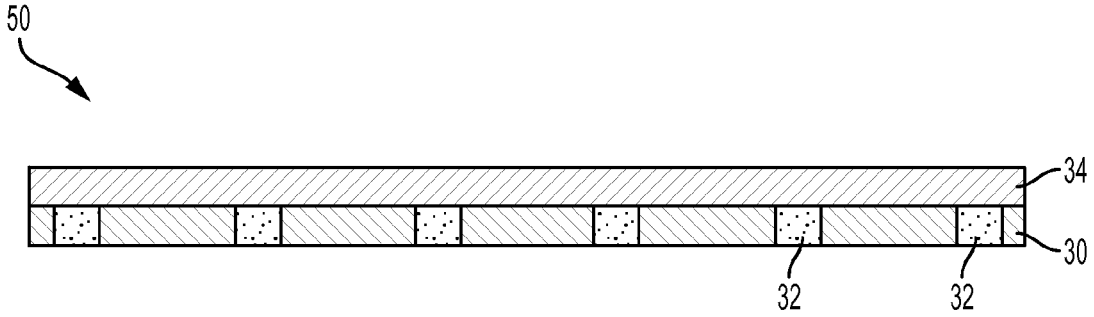
FIG. 4 is a schematic cross-section of a metal sheet stack including a sheet having heat-treated fastener regions, according to an embodiment.

With reference to FIG. 4, a cross-section of a stack 50 of sheets is shown including a metal sheet 30 including a plurality of heat-treated fastener regions 32. The cross-section may correspond to line A-A in FIG. 2. The stack 50 is shown with one additional sheet 34, however, there may be a plurality of additional sheets. The sheet 34 may be formed of any suitable material, such as a metal (ferrous or non-ferrous), a polymer, or a composite (e.g., fiber composite, such as carbon fiber). The sheet 34 may be formed of, for example, steel, aluminum, magnesium, titanium, or other metals, or alloys thereof. In at least one embodiment, the sheet 34 is formed of aluminum or aluminum alloy. As described above, steel and aluminum sheets generally cannot be joined by welding, therefore sheet 30 may include heat-treated fastener regions 32 to facilitate easier and more robust mechanical fastening between the sheets (e.g., by SPRs). If there are additional sheets in the stack 50, any or all sheets that are difficult to rivet (e.g., tensile strength of ≥1200 MPa) may include heat-treated fastener regions 32 similar to those in sheet 30. Some or all of the heat-treated regions 32 of the sheets may align to allow a fastener, such as a rivet or SPR, to be inserted therein.

As a result of the heat treatment process (e.g., resistive heating or other), the fastener regions 32 of the metal sheet 30 may have a lower strength and/or increased ductility compared to the rest of the sheet 30. The fastener regions 32 may also have a different microstructure than the rest of the sheet 30. For example, a portion, all, or substantially all (e.g., ≥98%) of the martensite that was present in the fastener regions 32 prior to the heat treatment may be converted to tempered martensite. The fastener regions 32 may have a tensile strength of less than or equal to 750 MPa. For example, the fastener regions 32 may have a tensile strength of 600 MPa to 750 MPa, or any sub-range therein, such as 600 MPa to 700 MPa. The fastener regions 32 may have a yield strength of less than or equal to 650 MPa, 600 MPa, 550 MPa, or 500 MPa. For example, the fastener regions 32 may have a yield strength of 400 MPa to 650 MPa, or any sub-range therein, such as 400 MPa to 600 MPa, 425 MPa to 600 MPa, 450 MPa to 600 MPa, or 500 MPa to 600 MPa. Accordingly, if the metal sheet 30 is formed of a UHSS having, for example, a tensile strength of at least 1200 MPa and yield strength of at least 800 MPa, then the fastener regions 32 may have significantly lower strength values. In addition, as a result of the heat treatment process, the fastener regions 32 may have an elongation at break of at least 10%, for example, at least 11% or at least 12%.

While the sheet 30 including heat-treated regions 32 is shown on the bottom of the stack 50, sheet 30 (or any sheet in the stack including heat-treated regions 32) may be located at any position in the stack. For example, sheet 30 may be on top and sheet 34 may be on bottom. Or, if there are two sheets 34, sheet 30 could be on the top, bottom, or in the middle. In at least one embodiment, the sheet 34 may be formed of an age hardened aluminum alloy, such as a 2XXX series, 6XXX series, or 7XXX series. Non-limiting examples of suitable 6XXX series aluminum alloys may include 6009, 6010, 6016, 6022, 6053, 6061, 6063, 6082, 6111, 6262, 6463, or others. Non-limiting examples of suitable 7XXX series aluminum alloys may include 7005, 7050, 7055, 7075, or others. In another embodiment, the sheet 34 may be formed of a non-age hardened aluminum alloys, such as a 5XXX series aluminum alloy. When the sheet 30 is joined to the sheet(s) 34, the fasteners may extend into/through the fastener region(s) 32 in the sheet 30. The sheet(s) 34 may not include fastener regions and may not receive any heat treatment or other processing at the locations where the fasteners will extend into the sheet(s) 34. Accordingly, the fasteners may extend into/through portions of the sheet(s) 34 where the properties of the sheet(s) 34 are the same as the bulk of the sheet(s). In one embodiment, the sheet(s) 34 may have substantially uniform properties throughout (e.g., tensile/yield strength, ductility, microstructure). As used herein, substantially uniform properties may refer to large-scale or macroscopic properties, not microscopic differences such as precipitates (e.g., in an age-hardened aluminum alloy).

Figure 5:
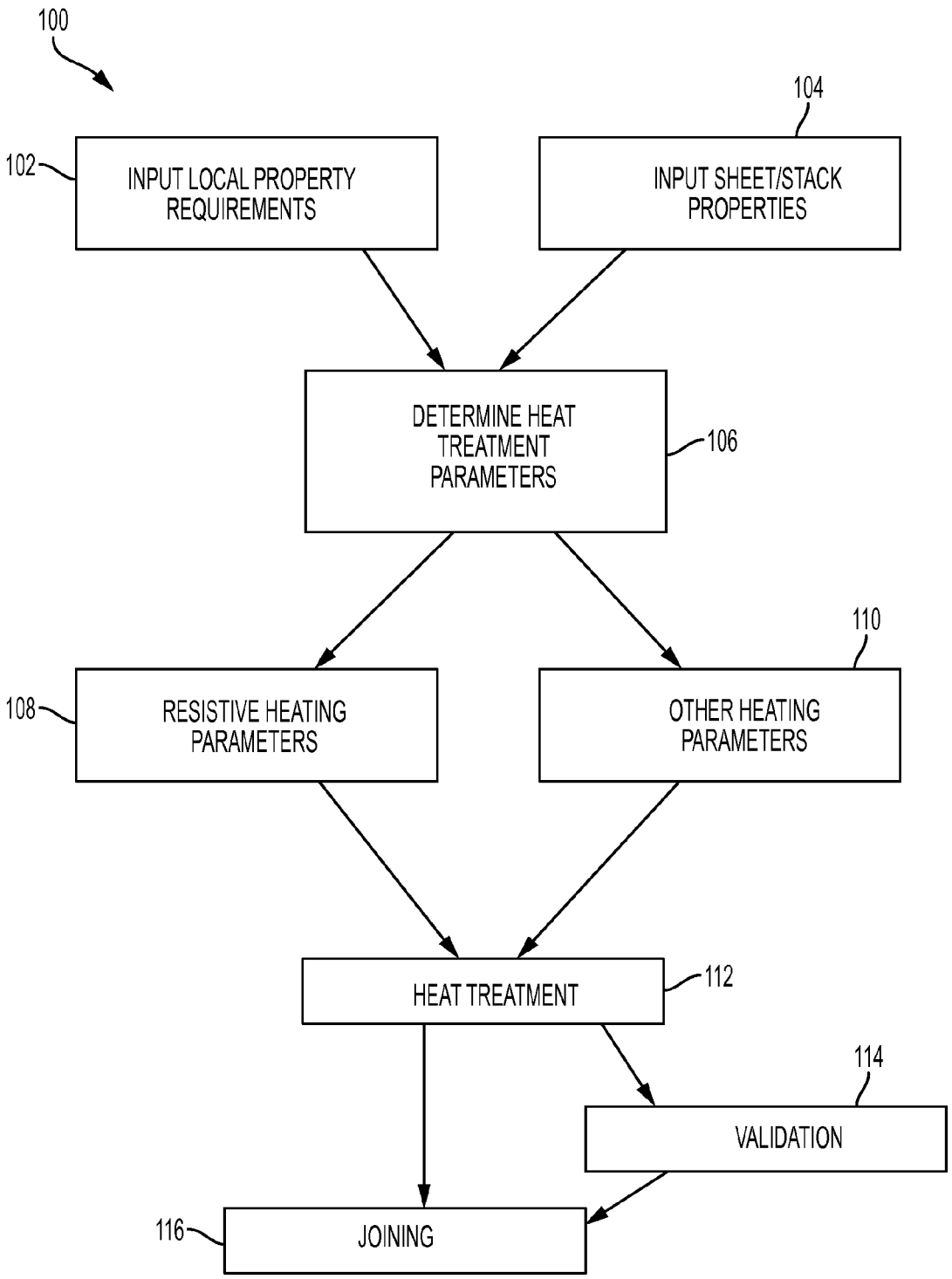
FIG. 5 is a flowchart for a heat treatment and joining process, according to an embodiment.

With reference to FIG. 5, a flowchart 100 is shown for a method of heat treating a metal sheet and a system for implementing the method is disclosed. The system may include heat treating equipment, such as a resistance heat treatment system (e.g., a resistance spot welder or modified version thereof), induction heating system, infrared heating system, flame heating system, or others. The system may also include a computer system, including a processor (e.g., CPU), memory (transitory and non-transitory), input devices (e.g., keyboard, mouse, etc.), a display, and other computer system components known in the art. The computer system may be a stand-alone system or may be incorporated into the heat treating equipment. The computer system may be connected to a network, which may be public (e.g., the Internet) or private.

In at least one embodiment, information regarding a metal sheet to be treated and the desired properties after treatment may be entered into the computer system. In step 102, information regarding the desired properties of the fastener regions may be input into the system. The desired properties may include information such as microstructure, tensile and/or yield strength, ductility, or others. For example, the information may include that the fastener regions should be converted to tempered martensite and/or that the fastener regions should have a tensile strength of 600 MPa to 750 MPa after the heat treatment.

In step 104, information regarding the properties of the metal sheet to be treated and, optionally, the properties of other sheets that will be included in the stack to be joined may be input into the computer system. The properties may include information such as composition, microstructure, tensile and/or yield strength and other mechanical properties, electrical and thermal properties, ductility, sheet geometry, number of sheets, or others. For example, the information may include that the sheet to be treated is a press-hardened boron steel, the composition (see, e.g., the 22MnB5 composition, above), the amount of martensite (e.g., 100% or another percentage), a tensile strength of 1400 MPa, and a thickness of 3 mm. Similar properties of the other sheets in the stack, as well as the number of sheets, may also be inputted. Accordingly, the computer system may have all of the relevant information regarding the properties of the materials in the stack going into the heat treatment, as well as the desired properties of the fastener regions after the heat treatment.

In step 106, the computer system may determine the appropriate heat treatment parameters to achieve the desired properties in the fastener regions. The heat treatment parameters may vary depending on the type of heat treatment equipment being used. If resistive heating equipment (e.g., resistance spot welding equipment) is used, then resistive heating parameters may be determined in step 108. If a different type of heating equipment is used (e.g., induction heating, flame heater, furnace, laser, etc.), then the relevant parameters may be determined in step 110. Regardless of the heating equipment used, the parameters may be determined in multiple ways. In one embodiment, the parameters may be determined based on empirical data, which may either be collected from previous heat treatments or from data available in the scientific literature. In another embodiment, the parameters may be determined or calculated based on models or simulations, which may be developed based on empirical data. A mixture of empirical and theoretical (e.g., calculations) may also be used, depending on the availability of each source of data for a certain composition.

If resistive heating equipment (e.g., resistance spot welding equipment) is used, then in step 108 the parameters of the resistive heating equipment may be determined. The parameters determined may include the current, the weld time (e.g., time current is flowing through the electrodes during one cycle), and the number of cycles. These parameters may be determined based on the information provided to the system (or previously stored in the system) in steps 102 and 104. Based on information such as the desired microstructure and strength and the composition, mechanical/electrical/thermal properties of the sheet, geometry of the sheet, microstructure of the sheet, and others, the system may determine resistive heat treatment parameters that will result in the desired properties. As described above, the parameters may be determined based on empirical data, models/simulations, or a combination thereof. For example, for a press-hardened 22MnB5 steel having a 100% martensitic microstructure, the system may determine that a current of 8 to 11 kA and a weld time of 50 to 1,000 ms may heat the sheet to 650° C. to 800° C. (or any sub-range therein). It may further determine that a total heating time of 0.5 to 90 seconds (or any sub-range therein) will result in heat-treated fastener regions having a tempered martensite microstructure and the tensile/yield strengths disclosed above. For example, the total heating time may be from 1 to 75 seconds, 5 to 60 seconds, 10 to 30 seconds, 15 to 90 seconds, 30 to 90 seconds, 30 to 60 seconds, or other sub-ranges. The total heating time may be accomplished using a number of resistive heating cycles (e.g., pressure time, weld time, hold time, and off time). Therefore, if a total cycle time is, for example, 2 seconds (e.g., including 500 ms of weld time), then there may be 30 cycles for a 60 second total heating time.

If a different type of heating equipment is used (e.g., induction heating, flame heater, furnace, laser, etc.), then in step 110 the parameters of the heating equipment may be determined based on the type of equipment. The number and type of parameters may vary depending on the type of equipment. For example, the parameters for induction heating may include the current and the time, which a furnace or flame heater may be the temperature and the time. These parameters may be determined based on the information provided to the system (or previously stored in the system) in steps 102 and 104. Based on information such as the desired microstructure and strength and the composition, mechanical/electrical/thermal properties of the sheet, geometry of the sheet, microstructure of the sheet, and others, the system may determine the heat treatment parameters that will result in the desired properties. As described above, the parameters may be determined based on empirical data, models/simulations, or a combination thereof. The system may determine that the sheet is to be heated at a temperature and time similar to those described for resistive heating, such as 650° C. to 800° C. for a total heating time of 0.5 to 90 seconds.

Once the heat treatment parameters have been determined in steps 108 or 110, the heat treatment may take place in step 112 according to the determined parameters. The heat treatment step 112 may be performed for each fastener region on a metal sheet. If multiple sheets in a stack are to receive heat treatments, then steps 102-112 may be repeated for each sheet based on the composition and other properties of each sheet. As described above, the heat treatment may include heating the fastener regions to a temperature that is below the Ac3 temperature but at or above a temperature near the Ac1 temperature. For example, the heat treatment may include heating the fastener regions to a temperature that is less than the Ac3 temperature and greater than 20° C. below the Ac1 temperature. In another embodiment, the heat treatment may include heating the fastener regions to a temperature within a certain range of the Ac1 temperature, such as ±25° C., 20° C., 15° C., 10° C., or 5° C. The heat treatment time may vary depending on the heat treating equipment used, the initial properties of the metal sheet, the desired properties of the fastener regions, or other factors. As described above, the temperature and time may be determined such that the fastener regions have reduced strength and/or increased ductility or such that the microstructure includes tempered martensite.

In step 114, the heat treatment may be validated to determine if the fastener regions have the desired properties. Step 114 may be optional, particularly if the heat treatment has shown to be robust over time. The validation step 114 may include one or more validation procedures. The validation procedures may be destructive or non-destructive. Examples of destructive procedures may include mechanical testing (e.g., strength, hardness, etc.) or sectioning for visual inspection (e.g., optical or electron microscopy). Non-destructive may be more cost effective and less wasteful, and may be performed on production components. Examples of non-destructive testing may include ultrasonic testing, magnetic-particle inspection, liquid/dye penetrant inspection, radiographic testing, remote visual inspection (RVI), eddy-current testing, and low coherence interferometry. In one embodiment, the validation step 114 may include using a micromagnetic, multiparameter, microstructure, and stress analysis (3MA) instrument. 3MA instruments may analyze physical quantities such as Eddy currents, Barkhausen noise, time signal of tangential magnetic field strength, and incremental permeability. 3MA instruments may non-destructively determine information regarding microstructure and material properties (e.g., tensile and yield strength).

The validation step 114, if performed, may inspect the fastener regions to confirm that they are within specification. The specification may require a certain microstructure, tensile/yield strength, and/or ductility, or other properties. The validation step 114 may ensure that the heat treatment process is both consistent and robust. Each heat treated sheet may be analyzed, or only a certain number or percent of sheets. Similarly, for each sheet, every heat-treated fastener region may be analyzed, or only a certain number or percent of regions. A tolerance level may be determined for each property to be analyzed. If any sheets, or a certain number/percentage of sheets, fail the validation step 114, the heat treatment parameters in steps 106-110 may be re-evaluated.

In step 116, the sheet metal stack may be joined using a fastener, for example, a rivet (e.g., a SPR). The stack may be joined after a validation step 114 or after the heat treatment step 112. The type of validation process may determine whether a validation step 114 occurs before joining the stack. For example, if non-destructive testing is used, then a validation step 114 may be performed before joining. However, if destructive testing is used to validate the heat treatment, then the tested sheet may no longer be suitable for joining and a separate sheet may be heat treated and then joined.

Accordingly, the disclosed method and system may provide an automated heat treatment process in which properties of the sheet to be treated and the desired properties are input into the system. The system then determines heat treatment parameters to achieve the desired properties and performs the heat treatment. The system may therefore flexibly adjust the heat treatment parameters for different sheet materials and sheet stacks to be joined. The system may use existing or modified resistance spot welding equipment to quickly and accurately heat treat regions of a metal sheet that are to be mechanically fastened to other sheet metals, for example, using self-piercing rivets.

Figure 6:
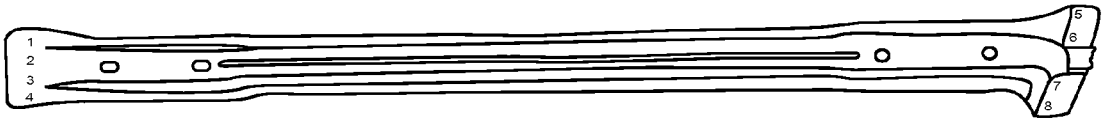
FIG. 6 is an ultra-high strength steel beam that may be heat-treated according to the disclosed methods using the disclosed system.

With reference to FIG. 6, an example of a steel component is shown that may be heat treated according to the disclosed methods using the disclosed systems. FIG. 6 shows a beam formed of press-hardened 22MnB5 steel that is to be joined to a 5XXX series aluminum alloy sheet. As shown, there are flanges on either side, each marked with four spots where the beam will be riveted to the aluminum sheet. On the left are spots 1-4 and on the right are spots 5-8.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A sheet metal stack comprising:
- a steel sheet including:
  - a bulk portion having a first tensile strength; and
  - one or more fastener regions having a second tensile strength of less than 750 MPa and lower than the first tensile strength and a microstructure that includes tempered martensite;
- a second sheet; and
- a fastener extending through each fastener region joining the steel sheet to the second sheet.

2. The stack of claim 1, wherein the second sheet is an aluminum sheet that is formed of a 5XXX, 6XXX, or 7XXX series aluminum alloy.

3. The stack of claim 1, further comprising one or more additional sheets.

4. The stack of claim 1, wherein the fastener regions have a width of 1 to 25 mm.

5. The stack of claim 1, wherein the fastener is a self-piercing rivet.

6. The stack of claim 1, wherein the second sheet has a substantially uniform tensile strength throughout.

7. A method of joining a stack of sheets, comprising:
- heat treating one or more regions of a steel sheet to form one or more fastener regions having a tensile strength that is below 750 MPa and lower than a bulk tensile strength of the steel sheet and a microstructure that includes tempered martensite; and
- inserting a fastener into the one or more fastener regions to join the steel sheet to a second sheet.

8. The method of claim 7, wherein the bulk tensile strength of the steel sheet is at least 1200 MPa.

9. The method of claim 7, wherein the heat treating step includes heating the one or more regions of the steel sheet to a temperature that is less than an Ac3 temperature of the steel sheet and greater than 20° C. below an Ac1 temperature of the steel sheet.

10. The method of claim 7, wherein the heat treating step includes heating the one or more regions of the steel sheet to a temperature that is within 25° C. of an Ac1 temperature of the steel sheet.

11. The method of claim 7, wherein the heat treating step includes heating the one or more regions of the steel sheet using resistive heating.

12. The method of claim 7, wherein the fastener is a self-piercing rivet.

13. The method of claim 7, wherein the one or more fastener regions have a width of 1 to 25 mm.

14. The method of claim 7, further comprising reducing a temperature of the one or more regions to an ambient temperature before the inserting step.

15. The method of claim 7, wherein the second sheet is formed from a 5XXX, 6XXX, or 7XXX series aluminum alloy.

16. A sheet metal stack comprising:
- a steel sheet including:
  - a bulk portion having a first tensile strength of at least 1200 MPa and a microstructure that includes 100% martensite; and
  - one or more fastener regions having a second tensile strength that is lower than the first tensile strength and a microstructure that includes tempered martensite;
- a second sheet; and
- a fastener extending through each fastener region joining the steel sheet to the second sheet.

17. The stack of claim 16, wherein the second sheet is an aluminum sheet that is formed of a 5XXX, 6XXX, or 7XXX series aluminum alloy.

18. The stack of claim 16, wherein the fastener is a self-piercing rivet.

19. The stack of claim 16, wherein the second sheet has a substantially uniform tensile strength throughout.

* * * * *